United States Patent [19]

Dobashi et al.

[11] Patent Number: 4,780,014

[45] Date of Patent: Oct. 25, 1988

[54] PAPER FEEDING CONTROLLING METHOD FOR A PRINTER INCLUDING PRINTING AT THE LEADING EDGE OF THE PAPER

[75] Inventors: Koichi Dobashi; Yoshihisa Kondo, both of Morioka, Japan

[73] Assignee: Alps Electric Co., Ltd., Tokyo, Japan

[21] Appl. No.: 94,255

[22] Filed: Sep. 8, 1987

[30] Foreign Application Priority Data

Nov. 26, 1986 [JP] Japan ..... 61-281061

[51] Int. Cl.[4] ..... B41J 13/20

[52] U.S. Cl. ..... 400/639.1

[58] Field of Search ..... 400/624, 625, 629, 639.1, 400/639.2

[56] References Cited

U.S. PATENT DOCUMENTS 4,275,969 6/1981 Matsuhisa et al. ..... 400/639.1
4,684,277 8/1987 Edstrom et al. ..... 400/639.1

FOREIGN PATENT DOCUMENTS 0173139 3/1986 European Pat. Off. ..... 400/639.1
0084885 5/1982 Japan ..... 400/639.1

OTHER PUBLICATIONS

IBM Technical Disclosure Bulletin, "Paper-Bail Actuation During Unattended Printout", Nilsson et al., vol. 19, No. 6, Nov. 1976, p. 1957.

*Primary Examiner*—Ernest T. Wright, Jr.
*Attorney, Agent, or Firm*—Guy W. Shoup; Leighton K. Chong; Paul J. Winters

[57] ABSTRACT

A paper feeding controlling method for a printer in which a record paper is first fed in a feeding direction until a leading end portion of the record paper reaches a recording position. In this position, the record paper will be printed for a first print line and then line spaced to allow subsequent printing for a next print line. When the end of the record paper advances farther than a paper bail roller after printing for several lines involving line spacing operations in this manner, the record paper is now fed reversely by a predetermined distance until the leading end of the record paper comes to a position forwardly of the paper bail roller in the feeding direction. Then, the paper bail roller is moved away from the platen, and the record paper is advanced by the predetermined distance with or without an addition of one line space distance. Finally, the paper bail roller is moved toward the platen until the record paper is held between the platen and the paper bail roller, and printing will be resumed.

1 Claim, 2 Drawing Sheets

PAPER FEEDING CONTROLLING METHOD FOR A PRINTER INCLUDING PRINTING AT THE LEADING EDGE OF THE PAPER

BACKGROUND OF THE INVENTION

This invention relates to a paper feeding controlling method for a printer.

A conventional paper feeding controlling method for a printer will first be described with reference to FIGS. 2(*a*), 2(*b*) and 2(*c*) of the accompanying drawings in which successive different stages of a paper feeding operation of a printer are illustrated in schematic representation.

The printer shown includes a print head 1 such as a wire dot print head or a thermal head, a platen 2, a first pressure roller 3 mounted for movement into and out of contact with the platen 2, a second pressure roller 4 having a smaller diameter than the first pressure roller 3 and mounted for movement into and out of contact with the platen 2 similarly to the first pressure roller 3, and a paper bail roller 5 for pressing record paper 6 against the platen 2.

Conventionally, in such a paper feeding mechanism as described above, record paper 6 is first fed by the platen 2 and the first and second pressure rollers 3 and 4 to a position a little farther than a recording position between the print head 1 and the platen 2 as shown in FIG. 2(*a*). Subsequently, while the record paper 6 is being fed further, the paper bail roller 5 is moved out of contact with the platen 2 so that a leading end of the record paper 6 passes between the platen 2 and the paper bail roller 5 as shown in FIG. 2(*b*) whereupon the feeding of the record paper 6 is stopped. Then, the paper bail roller 5 is moved toward the platen 2 to press the record paper 6 against the platen 2 as shown in FIG. 2(*c*). Thereafter, printing will be initiated.

It is to be noted that the position of the leading end of the record paper 6 in the paper feeding operation described above can be readily determined by controlling the amount of rotation of the platen 2 with reference to a distance from a position at which the first pressure roller 3 and the platen 2 contact with each other to another position of either the print head 1 or the paper bail roller 5.

However, such a paper feeding controlling method as described above has a drawback that, since printing is initiated after such a condition as shown in FIG. 2(*c*) has been reached, a portion of the record paper 6 from the print head 1 to the paper bail roller 5 cannot be printed and hence will remain blank.

SUMMARY OF THE INVENTION

It is an object of the present invention to provide a paper feeding controlling method for a printer which allows the printer to print record paper from a leading end portion of the same.

According to the present invention, there is provided a paper feeding controlling method for a printer which comprises the steps of rotating a platen by a predetermined amount to transport record paper in a feeding direction until a leading end portion of the record paper reaches a recording position to allow subsequent printing of the record paper for a first print line, line spacing the record paper after printing for the first and each subsequent print line until the leading end of the record paper advances farther than a paper bail roller, feeding the record paper by a second predetermined distance in the reverse direction until the leading end of the record paper comes to a position forwardly of the paper bail roller in the feeding direction, moving the paper bail roller away from the platen, transporting the record paper in the feeding direction by a distance equal to the second predetermined distance or equal to the second predetermined distance plus one line space distance, and moving the paper bail roller toward the platen until the record paper is held between the platen and the paper bail roller.

Accordingly, printing of record paper can be started just after a leading end portion of the record paper has been brought to the recording position. Therefore, the record paper can be printed fully from such a leading end portion thereof.

The above and other objects, features and advantages of the present invention will become apparent from the following description and the appended claim, taken in conjunction with the accompanying drawings.

DETAILED DESCRIPTION OF THE PREFERRED EMBODIMENT

Figure 1:
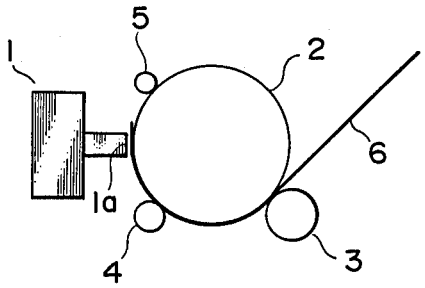
FIGS. 1(*a*) to 1(*e*) are schematic representations illustrating successive steps of a paper feeding controlling method according to the present invention.
Figure 1:
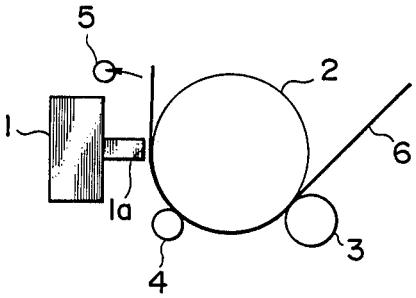
Figure 1:
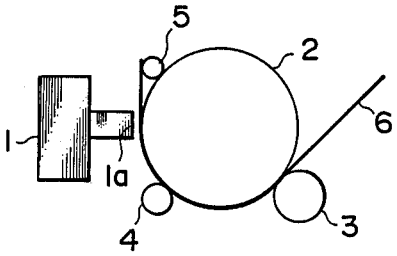
Figure 1:
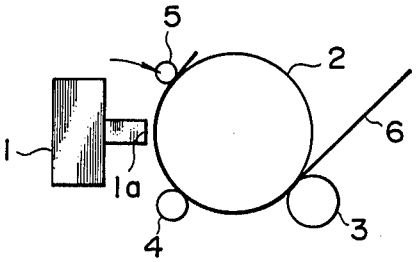
Figure 1:
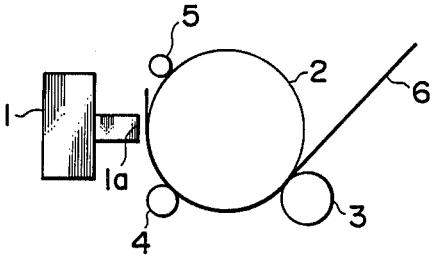
Figure 2:
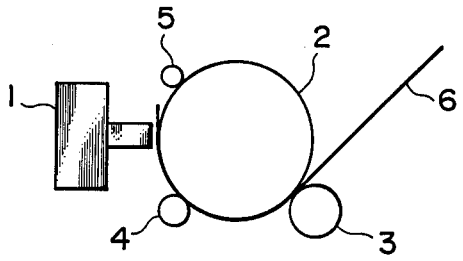
PRIOR ART FIG. 2 (a)
FIGS. 2(*a*) to 2(*c*) are similar views but illustrating successive steps of a conventional paper feeding controlling method.
Figure 2:
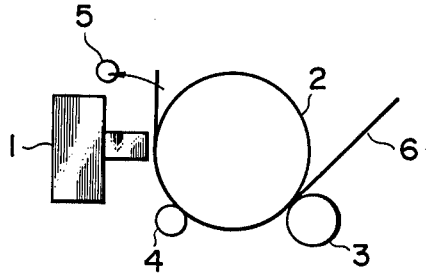
PRIOR ART FIG. 2 (b)
Figure 2:
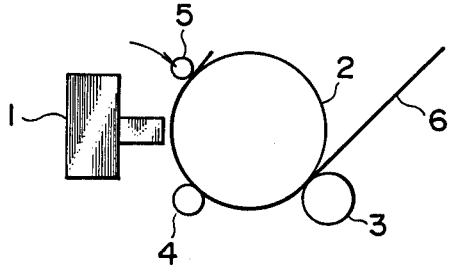
PRIOR ART FIG. 2 (c)

Referring to FIGS. 1(*a*) to 1(*e*), successive different steps of a paper feeding controlling method according to the present invention are shown in schematic representation. In those figures, a paper feed mechanism itself is similar to the conventional paper feed mechanism described hereinabove with reference to FIGS. 2(*a*) to 2(*c*). Accordingly, further description of the paper feed mechanism is omitted herein.

At first upon insertion of record paper 6, as the platen 2 is rotated, the record paper 6 is fed, by operation of the platen 2 and the first and second pressure rollers 3, 4, until a leading end portion of record paper 6 is opposed to an end portion (recording portion) 1*a* of the print head 1 as shown in FIG. 1(*a*). In this position, printing will be initiated. After printing for a print line, the record paper 6 will be fed by one line space distance to allow subsequent printing for a next print line. Such a subsequence of operation of printing and line spacing will be repeated until the leading end of the record paper 6 advances beyond the paper bail roller 5 as shown in FIG. 1(*b*). Subsequently, the platen 2 is rotated in the reverse direction to feed the record paper 6 by a predetermined distance to a position in which the leading end the record paper 6 is located forwardly of the paper bail roller 5 in the feeding direction, that is, intermediately between the end portion 1a of the print head 1 and the paper bail roller 5, as shown in FIG. 1(*c*). Then, the paper bail roller 5 is moved in a direction indicated by an arrow mark in FIG. 1(*d*) out of contact with the platen 2 and then the record paper 6 is fed in the forward direction again by a distance equal to the predetermined distance over which the record paper 6 has formerly been fed in the reverse direction or else by a distance equal to the predetermined distance plus one line space distance as shown in FIG. 1(*d*). Then, the paper bail roller 5 is moved in a direction indicated by an arrow mark in FIG. 1(*e*) until the record paper 6 is held between the platen 2 and the paper bail roller 5 as shown in FIG. 1(*e*). In this position, printing will be resumed. Here, such motions of the paper bail roller 5 as described above may be attained by suitable energization of a solenoid not shown.

It will be appreciated that if printing is started at such a position of the record paper 6 as shown in FIG. 1(*a*) with the paper bail roller 5 positioned out of contact with the platen 2 as shown in FIG. 1(*d*) and then the paper bail roller 5 is moved into contact with the platen 2 at a time when the leading end of the record paper 6 passes a position between the paper bail roller 5 and the platen 2 as seen in FIG. 1(*d*), it is possible to print the record paper 6 from the leading end portion thereof. However, where color printing is to be effected using a multi-color ribbon not shown, printing with the paper bail roller 5 spaced from the platen 2 is defective in that a ribbon cassette not shown in which the multi-color ribbon is contained may interfere with the paper bail roller 5 when the ribbon cassette is shifted up and down.

To the contrary, if the paper bail roller 5 is correlated with a ribbon shift mechanism such that shifting movement of a ribbon cassette is prohibited when the paper bail roller 5 is out of contact with the platen 2, the ribbon cassette will not collide with the paper bail roller 5 even when color printing is effected involving the paper feeding controlling method of the present invention described above.

As apparent from the foregoing description, the paper feeding controlling method according to the present invention provides a remarkable effect that record sheet 6 can be printed normally from a leading end portion thereof and accordingly can be used effectively and efficiently.

Having now fully described the invention, it will be apparent to one of ordinary skill in the art that may changes and modifications can be made thereto without departing from the spirit and scope of the invention as set forth herein.

What is claimed is:

1. A paper feeding controlling method for a printer of the type which includes a platen, a pressure roller for contacting under pressure with said platen and for cooperating with said platen to transport record paper, and a paper bail roller located rearwardly of a recording position in a feeding direction of record paper for pressing a recorded portion of record paper against said platen, comprising the steps of: rotating said platen by a predetermined amount to transport record paper in the feeding direction until a leading end portion of the record paper reaches the recording position to allow subsequent printing of the record paper for a first print line; line spacing the record paper after printing for the first and each subsequent print line until the leading end of the record paper advances farther than said paper bail roller; feeding the record paper by a second predetermined distance in the reverse direction until the leading end of the record paper comes to a position forwardly of said paper bail roller in the feeding direction; moving said paper bail roller away from said platen; transporting the record paper in the feeding direction by a distance equal to the second predetermined distance or equal to the second predetermined distance plus one line space distance; and moving said paper bail roller toward said platen until the record paper is held between said platen and said paper bail roller.

* * * * *